US009766006B2

(12) United States Patent
Kim et al.

(10) Patent No.: US 9,766,006 B2
(45) Date of Patent: Sep. 19, 2017

(54) ICE MAKER

(71) Applicant: COWAY CO., LTD., Chungcheongnam-do (KR)

(72) Inventors: Yong-Bum Kim, Seoul (KR); Jin-Pyo Hong, Seoul (KR); Hyun-Woo Lee, Seoul (KR)

(73) Assignee: Coway Co., Ltd (KR)

( * ) Notice: Subject to any disclaimer, the term of this patent is extended or adjusted under 35 U.S.C. 154(b) by 154 days.

(21) Appl. No.: 14/411,791

(22) PCT Filed: Jun. 25, 2013

(86) PCT No.: PCT/KR2013/005615

§ 371 (c)(1),
(2) Date: Dec. 29, 2014

(87) PCT Pub. No.: WO2014/003422

PCT Pub. Date: Jan. 3, 2014

(65) Prior Publication Data

US 2015/0143838 A1 May 28, 2015

(30) Foreign Application Priority Data

Jun. 29, 2012 (KR) ..... 10-2012-0071185
Sep. 5, 2012 (KR) ..... 10-2012-0098329
Jun. 19, 2013 (KR) ..... 10-2013-0070339

(51) Int. Cl.
*F25C 1/00* (2006.01)
*F25C 5/02* (2006.01)
(Continued)

(52) U.S. Cl.
CPC ..... *F25C 1/00* (2013.01); *F25C 1/08* (2013.01); *F25C 5/02* (2013.01); *F25C 5/08* (2013.01);
(Continued)

(58) Field of Classification Search
CPC .... F25C 1/045; F25C 1/08; F25C 1/12; F25C 2400/08; F25C 2500/02
See application file for complete search history.

(56) References Cited

U.S. PATENT DOCUMENTS 3,433,030 A * 3/1969 Jacobs ..... F25C 1/08 219/201
4,458,503 A 7/1984 Nelson
(Continued)

FOREIGN PATENT DOCUMENTS

CN 2755518 2/2006
FR 2 333 420 6/1977
(Continued)

OTHER PUBLICATIONS

Chinese Office Action dated Jan. 19, 2016 issued in counterpart application No. 201380034235.6, 6 pages.
(Continued)

*Primary Examiner* — Christopher R Zerphey
(74) *Attorney, Agent, or Firm* — The Farrell Law Firm, P.C.

(57) ABSTRACT

An ice maker is provided that varies an amount of heat transferred between an ice making member connected to a cooling unit and water being in direct or indirect contact with the ice making member according to portions of the ice making member, and producing ice in various forms including rounded ice without edges, especially spherical ice, on the ice making member, the ice maker including a cooling unit performing cooling; at least one ice making member connected to the cooling unit and being in direct or indirect contact with water to allow ice to be produced thereon; with an amount of heat transferred between the ice making member and the water being in direct or indirect contact with the ice making member varies according to portions of the
(Continued)

ice making member, such that ice is produced in various forms on the ice making member.

16 Claims, 12 Drawing Sheets

(51) Int. Cl.
*F25C 5/08* (2006.01)
*F25C 1/08* (2006.01)

(52) U.S. Cl.
CPC ..... *F25C 2400/08* (2013.01); *F25C 2500/02* (2013.01)

(56) References Cited

U.S. PATENT DOCUMENTS 4,685,304 A 8/1987 Essig
4,959,966 A * 10/1990 Dimijian ..... F25C 1/045 62/138
5,187,948 A * 2/1993 Frohbieter ..... F25C 1/08 62/351

FOREIGN PATENT DOCUMENTS

| | | |
|---|---|---|
| JP | 07-019684 | 1/1995 |
| JP | 09203573 | 8/1997 |
| KR | 1020040085605 | 10/2004 |
| KR | 1020080022479 | 3/2008 |
| KR | 100820675 | 4/2008 |
| KR | 100936610 | 1/2010 |
| KR | 100936691 | 1/2010 |
| WO | WO 2006/002224 | 1/2006 |

OTHER PUBLICATIONS

European Search Report dated May 28, 2015 issued in counterpart application No. 13810478.1-1605.

* cited by examiner

ICE MAKER

PRIORITY

This application is a National Phase Entry of PCT International Application No. PCT/KR2013/005615, which was filed on Jun. 25, 2013, and claims priority to Korean Patent Application No. 10-2012-0071185, which was filed on Jun. 29, 2012, to Korean Patent Application No. 10-2012-0098329, which was filed on Sep. 5, 2012, and to Korean Patent Application No. 10-2013-0070339, which was filed on Jun. 19, 2013, the contents of each of which are incorporated herein by reference.

TECHNICAL FIELD

The present disclosure relates to an ice maker producing ice, and more particularly, to an ice maker varying an amount of heat transferred between an ice making member connected to a cooling unit and water being in direct or indirect contact with the ice making member according to portions of the ice making member, thereby producing ice in various forms thereon.

BACKGROUND ART

An ice maker is an apparatus for cooling water to a temperature below zero degrees Celsius, freezing point, producing ice, and supplying the ice to a user. Such an ice maker is provided in a refrigerator requiring an ice producing function, a water purifier having an ice maker, or the like.

Examples of the ice maker may include an immersion-type ice maker immersing, an immersion member having a refrigerant flowing therein in water and producing ice on the immersion member, a spray-type ice maker spraying water into an ice making mold provided with a cooling unit, such as an evaporator having a refrigerant flowing therein, and producing ice in the ice making mold, or a flow-type ice maker in which water flows into an ice making mold provided with a cooling unit, such as an evaporator having a refrigerant flowing therein, and producing ice in the ice making mold.

Forms of ice produced in the ice maker may be varied, according to forms of an ice making mold provided therein. For example, angular ice or rounded ice may be produced according to forms of an ice making mold. Also, spherical ice may be produced by providing an ice making mold in a form of a sphere or a hemisphere.

Accordingly, in the conventional art, there arises an issue in that an ice making mold needs to be provided in a form corresponding to a form of ice desired to be produced. For example, in order to produce rounded ice without edges, a rounded ice making mold needs to be used. In particular, in order to produce spherical ice, an ice making mold in a form of a sphere or a hemisphere needs to be involved.

As such, the use of such an ice making mold is essential in order to produce various types of ice, for example, rounded ice without edges or spherical ice. Thus, in order to produce rounded ice without edges or spherical ice, a cumbersome ice maker having a relatively complex configuration may be required, since water needs to be held in an ice making mold having a rounded, spherical, or hemispherical form.

Accordingly, a disadvantage of the ice maker according to the conventional art is that ice may not be easily produced in various forms.

DISCLOSURE

Technical Problem

The present disclosure is provided in consideration of at least one of the demands or issues arising in the field of conventional ice makers, as mentioned above.

An aspect of the present disclosure provides an ice maker producing ice in various forms, through a simplified configuration, without using an ice making mold provided in a form corresponding to that of desired ice.

An aspect of the present disclosure also provides an ice maker able to readily produce ice in various forms.

An aspect of the present disclosure also provides an ice maker producing rounded ice without edges, especially spherical ice, through a simplified configuration, without using an ice making mold provided in a rounded, spherical or a hemispherical form.

An aspect of the present disclosure also provides an ice maker readily producing rounded ice without edges, especially spherical ice.

Technical Solution

In order to resolve at least one of the aforementioned issues, an ice maker according to exemplary embodiments may have characteristics as described in the following:

The present disclosure is directed to an ice maker varying an amount of heat transferred between an ice making member connected to a cooling unit and water being in direct or indirect contact with the ice making member according to portions of the ice making member, and producing ice thereon in various forms including, for example, rounded ice without edges, especially spherical ice.

According to an aspect of the present disclosure, an ice maker may include a cooling unit performing cooling; and at least one ice making member connected to the cooling unit and being in direct or indirect contact with water to allow ice I to be produced thereon, wherein an amount of heat transferred between the ice making member and the water being in direct or indirect contact with the ice making member varies according to portions of the ice making member, such that ice I is produced in various forms thereon.

The ice making member may include a heat transfer control member having a heat transfer rate different from that of the ice making member.

The ice making member may include two or more materials having different heat transfer rates.

The ice making member may have different thicknesses varying according to the portions of the ice making member.

A lower portion of the ice making member may be provided in a rounded form to produce rounded ice I without edges on the ice making member.

An amount of heat transferred to the lower portion of the ice making member may be greater than that transferred to a portion of the ice making member other than the lower portion of the ice making member.

The amount of heat transferred to the portion of the ice making member other than the lower portion of the ice making member may be decreased in an upward direction thereof.

The ice making member may include a heat transfer control member having a heat transfer rate lower than that of the ice making member, and a lower portion of the heat transfer control member may be spaced apart from the lower portion of the ice making member by a predetermined distance.

The heat transfer control member may be provided with a through-hole through which the ice making member penetrates.

The through-hole may be narrowed in a laterally slanted manner to have a cross section decreasing in a downward direction thereof, and a lower portion of the through-hole may be tightly fitted to the ice making member, and a space between the ice making member and the through-hole is increased in an upward direction thereof.

The through-hole may have a form corresponding to a form of the ice making member, and a thickness of the heat transfer control member may be increased in an upward direction thereof.

The ice making member may be immersed in water to be in direct or indirect contact therewith.

The ice making member may be sprayed with water to be in direct or indirect contact therewith.

Water may flow in the ice making member to be in direct or indirect contact therewith.

The heat transfer control member may be provided with a heating element.

The heating element may be an electric heating wire.

The electric heating wire may be provided around an outer circumference of the heat transfer control member or may be inserted into the heat transfer control member.

The outer circumference of the heat transfer control member may be provided with an electric heating wire groove, and the electric heating wire may be provided in the electric heating wire groove.

Water may flow along the outer circumference of the heat transfer control member when ice is separated.

A water supply pipe connected to a water source may pass through an upper portion of the heat transfer control member, and the water supply pipe may be provided with a supply hole to allow water to flow along the outer circumference of the heat transfer control member.

Advantageous Effects

According to exemplary embodiments of the present disclosure, an ice maker may vary an amount of heat transferred between an ice making member and water being in direct or indirect contact therewith according to portions of the ice making member, and produce ice thereon in various forms, including, for example, rounded ice without edges, especially spherical ice.

According to exemplary embodiments of the present disclosure, an ice maker may readily produce ice in various forms.

According to exemplary embodiments of the present disclosure, an ice maker may produce ice in various forms, through a simplified configuration, without using an ice making mold provided in a rounded, spherical or a hemispherical form.

According to exemplary embodiments of the present disclosure, an ice maker may readily produce rounded ice without edges, especially spherical ice.

MODE FOR INVENTION

Figure 1:
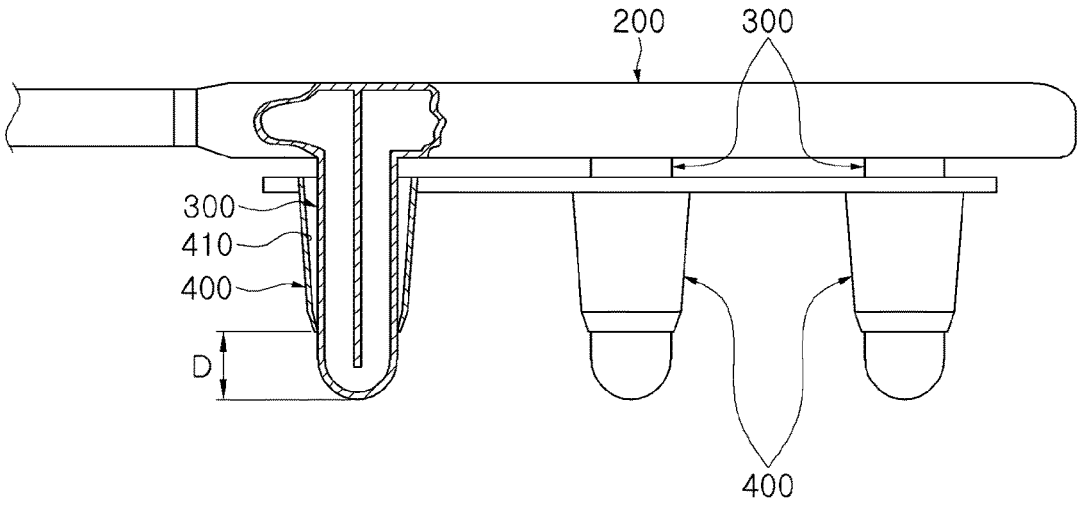
FIG. 1 is a view illustrating an ice maker according to an exemplary embodiment of the present disclosure.

Hereinafter, an ice maker according to exemplary embodiments of the present disclosure will be described in detail for more complete and thorough understanding of the above-mentioned characteristics of the ice maker.

The following detailed description is provided to assist the reader in gaining a comprehensive understanding of the methods and/or apparatuses described herein. However, various changes, modifications, and equivalents of the apparatuses and/or methods described herein will be apparent to one of ordinary skill in the art. Also, descriptions of functions and constructions that are well known to one of ordinary skill in the art may be omitted for increased clarity and conciseness. Throughout the drawings and the detailed description, the same reference numerals refer to the same elements. The drawings may not be to scale, and the relative size, proportions, and depiction of elements in the drawings may be exaggerated for clarity, illustration, and convenience.

Exemplary embodiments of the present disclosure may include varying an amount of heat transferred between an ice making member connected to a cooling unit and water being in direct or indirect contact therewith according to portions of the ice making member, and producing ice thereon in various forms including, for example, rounded ice without edges, especially spherical ice.

As illustrated in FIGS. 1 through 6, an ice maker 100 according to an exemplary embodiment of the present disclosure may include a cooling unit 200 and at least one ice making member 300.

Figure 8:
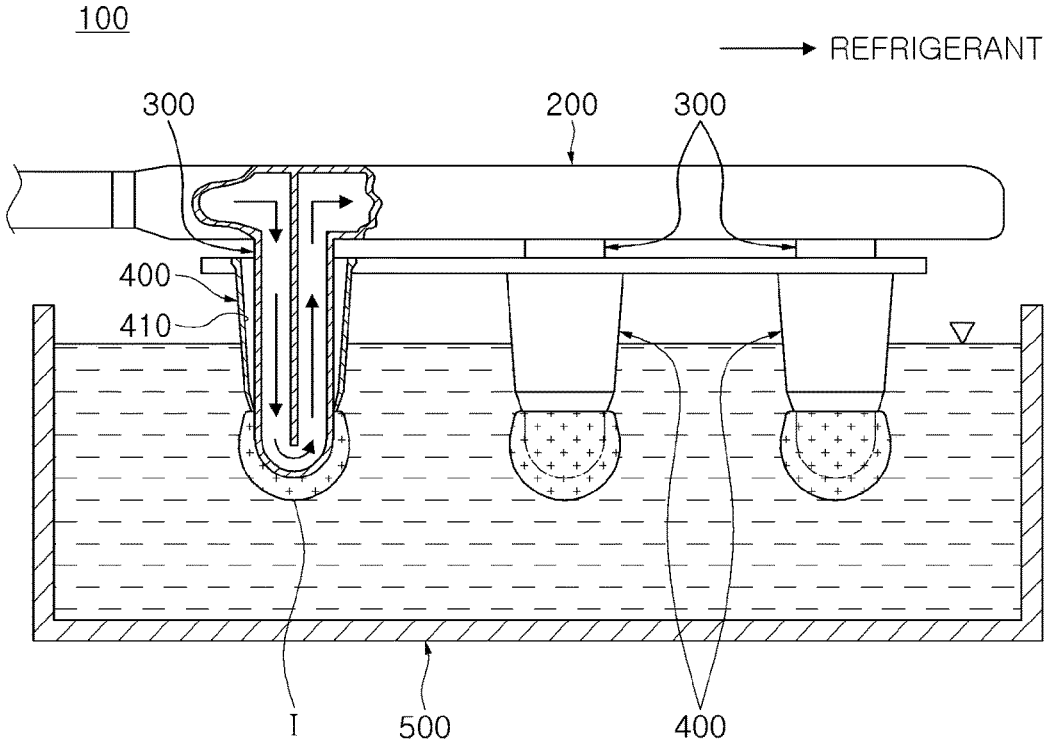
FIGS. 8 through 10 are views illustrating operations of the ice maker of FIG. 1.
Figure 9:
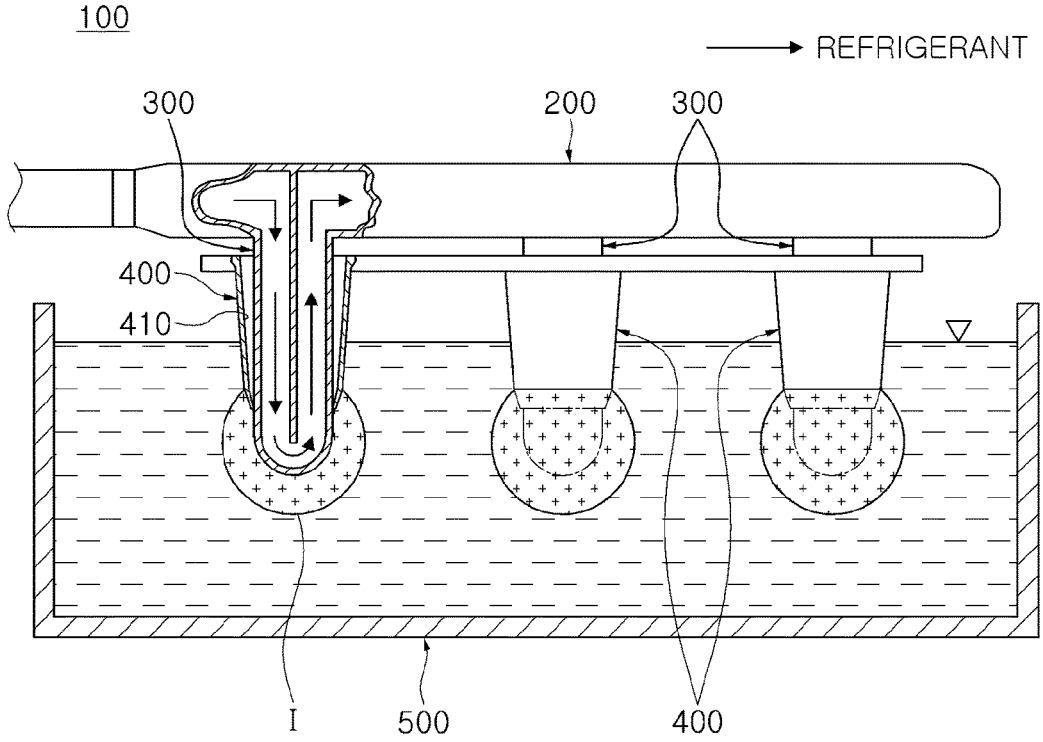
Figure 10:
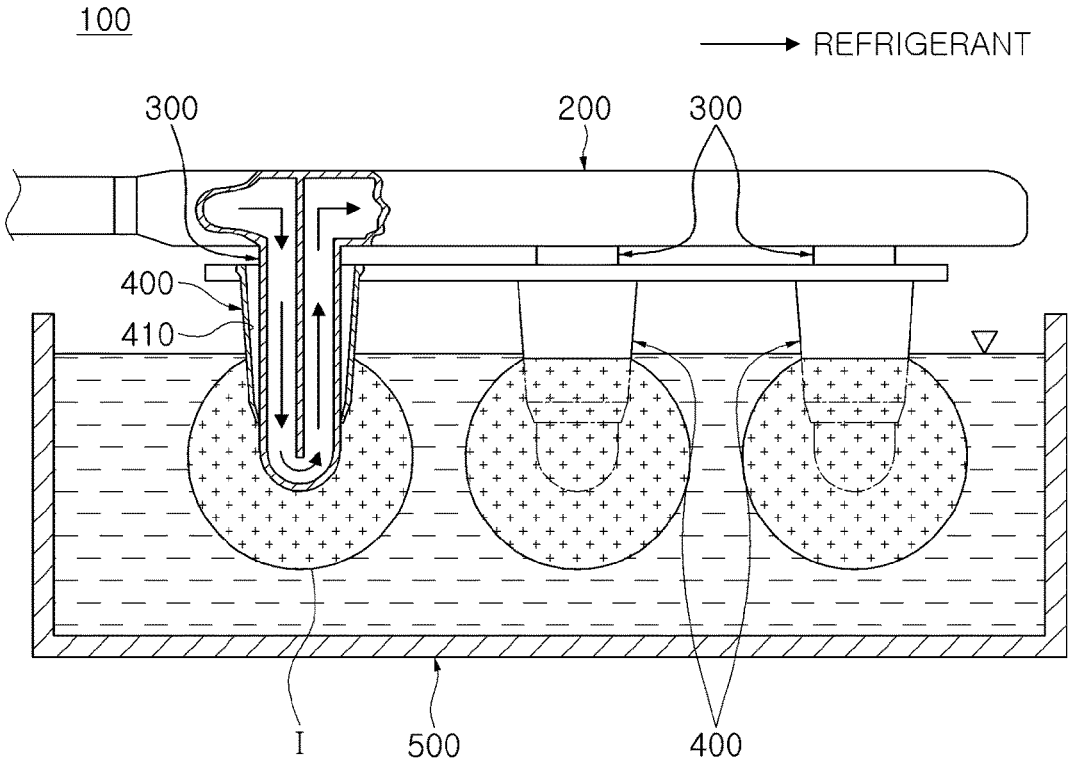

The cooling unit 200 may perform cooling. To this end, as illustrated in FIGS. 1 through 6, the cooling unit 200 may be an evaporator included in a cooling cycle. Accordingly, as illustrated in FIGS. 8 through 10, a refrigerant may flow in the cooling unit 200. However, the cooling unit 200 is not limited to containing such an evaporator, and thus any device for cooling, well known to one of ordinary skill in the art, such as a thermoelectric module (not illustrated) including a thermoelectric element may be used.

As illustrated in FIGS. 1 through 6, the ice making member 300 may be connected to the cooling unit 200. Accordingly, when cooling is performed in the cooling unit 200, the ice making member 300 may be cooled. As illustrated in FIGS. 1 through 6, in an instance in which the cooling unit 200 is an evaporator in which a refrigerant flows, the refrigerant may also be allowed to flow in the ice making member 300. However, the refrigerant may not be allowed to flow in the ice making member 300. In this instance, when the refrigerant flows in the cooling unit 200, the evaporator, the ice making member 300 may be cooled. Also, in an instance in which the cooling unit 200 is a thermoelectric module including a thermoelectric element, the ice making member 300 may be connected to the thermoelectric module, the cooling unit 200. When the thermoelectric module, the cooling unit 200, operates, the ice making member 300 may be cooled.

As illustrated in FIGS. 1 through 6, an upper portion of the ice making member 300 may be connected to the cooling unit 200. However, the portion of which the ice making member 300 is connected to the cooling unit 200 is not limited thereto, and any portion, for example, a lower portion or a central portion, of the ice making member 300 connectable to the cooling unit 200 may be used.

Water may be in direct or indirect contact with the ice making member 300. In other words, the ice making member 300 may be in indirect contact with water through being in direct contact with water in the vicinity of the ice making member 300 or through being in contact with an object in contact with the ice making member 300.

In order for water to be in direct or indirect contact with the ice making member 300, the ice making member 300 may be immersed in water as illustrated in FIGS. 8 through 10. For example, as illustrated in FIGS. 8 through 10, water may be supplied to a tray member 500 disposed below the ice making member 300 and held therein, and the ice making member 300 may be immersed in the water supplied to the tray member 500 and held therein.

However, besides the operations of the ice maker illustrated in FIGS. 8 through 10, although not further illustrated, water may be sprayed into the ice making member 300 to be in direct or indirect contact therewith. Also, water may flow along the ice making member 300 to be in direct or indirect contact therewith. However, the manner of water being in direct or indirect contact with the ice making member 300 is not limited thereto, and any contacting manner well known to one of ordinary skill in the art may be used.

Based on such a manner, as illustrated in FIGS. 8 through 10, when the cooling unit 200 performs cooling, the ice making member 300 may be cooled. For example, in an instance in which the cooling unit 200 is an evaporator, when a cold refrigerant flows in the evaporator, the ice making member 300 may be cooled or the cold refrigerant may also flow in the ice making member 300. Further, in an instance in which the cooling unit 200 is a thermoelectric module including a thermoelectric element, the ice making member 300 may be cooled by driving the thermoelectric module, the cooling unit 200.

Accordingly, heat may be transferred, to the ice making member 300, from the water being in direct or indirect contact with the ice making member 300, for example, as illustrated in FIGS. 8 through 10, the water held in a tray member 500 in which the ice making member 300 is immersed. As illustrated in FIGS. 8 through 10, in an instance in which the cooling unit 200 is the evaporator and the refrigerant also flows in the ice making member 300, heat may be transferred from the water held in the tray member 500 to the refrigerant flowing in the ice making member 300. Consequently, water in the vicinity of the ice making member 300 may be cooled to below zero degrees Celsius, freezing point, and ice I may be produced on the ice making member 300 as illustrated in FIGS. 8 through 10.

In the ice maker 100 according to the exemplary embodiment, an amount of heat transferred between the ice making member 300 and the water being in direct or indirect contact therewith may be varied, according to portions of the ice making member 300. For example, as illustrated in FIGS. 8 through 10, in an instance in which the cooling unit 200 is the evaporator and the refrigerant also flows in the ice making member 300, an amount of heat transferred between the refrigerant flowing in the ice making member 300 and the water in which the ice making member 300 is immersed may vary according to the portions of the ice making member 300.

Accordingly, ice I may be produced in various forms as illustrated in FIGS. 3 through 6, including, for example, rounded ice I without edges, especially spherical ice I as illustrated in FIGS. 8 through 10 on the ice making member 300 by varying the amount of heat transferred between the ice making member 300 and the water being in direct or indirect contact therewith according to the portions of the ice making member 300, and varying a form of the ice making member 300, for example, a form of the lower portion of the ice making member 300 on which ice I is initially formed.

Thus, since an ice making mold provided in a form corresponding to a form of ice desired to be produced, for example, a sphere or a hemisphere, is unnecessary to produce rounded ice I without edges or spherical ice I, ice may be produced in various forms on the ice making member 300 through a simplified configuration. Accordingly, various forms of ice may be readily produced.

To this end, as illustrated in FIGS. 1 through 6, a heat transfer control member 400 having a heat transfer rate different from that of the ice making member 300 may be provided in the ice making member 300. For example, the heat transfer control member 400 may have a heat transfer rate lower than that of the ice making member 300. Accordingly, as illustrated in FIGS. 3 through 6 and FIGS. 8 through 10, a size of ice I produced on a portion of the ice making member 300 in which the heat transfer control member 400 is not provided may be greater than a size of ice I produced on the heat transfer control member 400. Thus, various forms of ice I may be produced including rounded ice I without edges, especially spherical ice I as illustrated in FIGS. 8 through 10, through the simplified configuration. Although dissimilar to what is described hereinbefore, the heat transfer control member 400 may have a heat transfer rate higher than that of the ice making member 300.

As illustrated in FIG. 1 and FIGS. 3 through 5, a lower portion of the heat transfer control member 400 may be spaced apart from the lower portion of the ice making member 300 by a predetermined distance D. Accordingly, as illustrated in FIG. 1 and FIGS. 3 through 5, a relatively large piece of ice I may be produced on the lower portion of the ice making member 300, in a form corresponding to a form of the lower portion of the ice making member 300 while a relatively small piece of ice I may be produced on the heat transfer control member 400.

Figure 5:
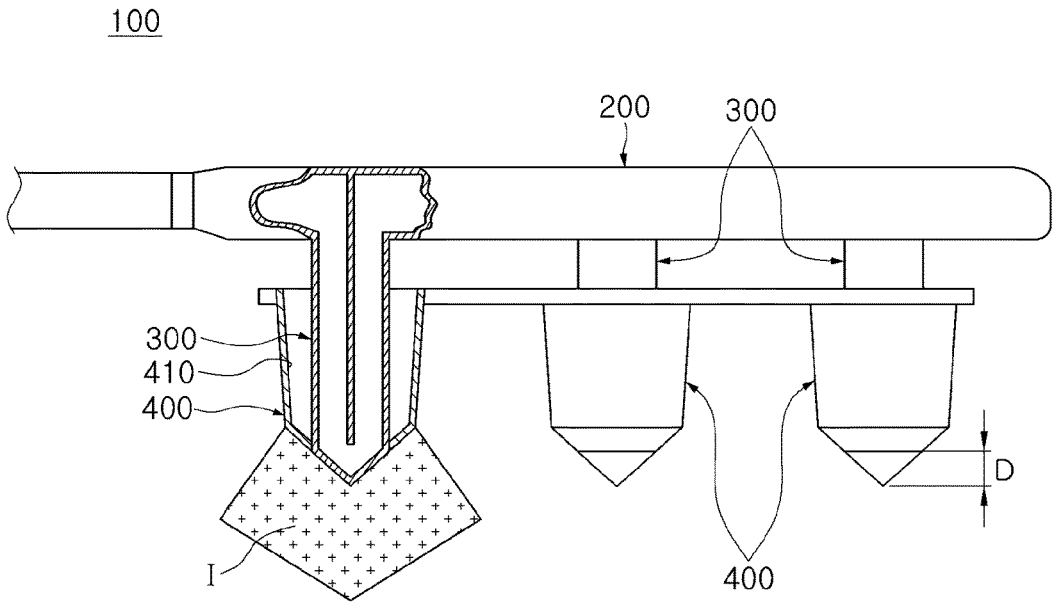

To this end, as illustrated in FIGS. 1 through 5, a through-hole 410 through which the ice making member 300 penetrates may be formed in the heat transfer control member 400. As illustrated in FIGS. 1 and 2 and FIGS. 4 and 5, the through-hole 410 may be narrowed in a laterally slanted manner to have a cross section decreasing in a downward direction thereof. Accordingly, as illustrated in FIG. 4 and FIGS. 8 through 10, the size of ice I to be produced on the heat transfer control member 400 may be decreased in an upward direction thereof, or as illustrated in FIG. 5, ice I may not be produced on the heat transfer control member 400.

Figure 3:
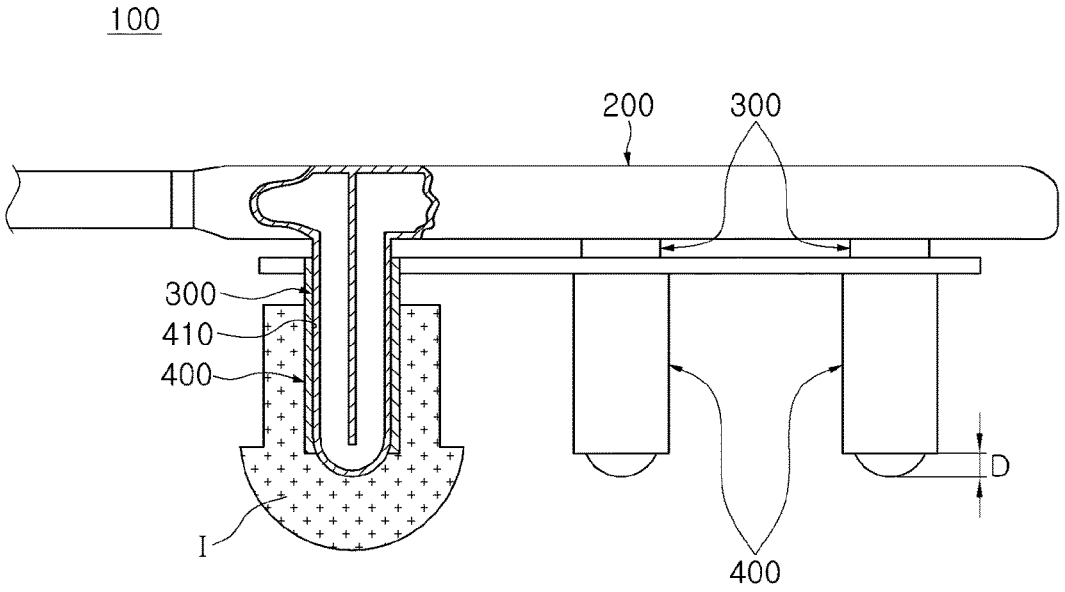
FIGS. 3 through 6 are views illustrating ice makers according to exemplary embodiments of the present disclosure.
Figure 4:
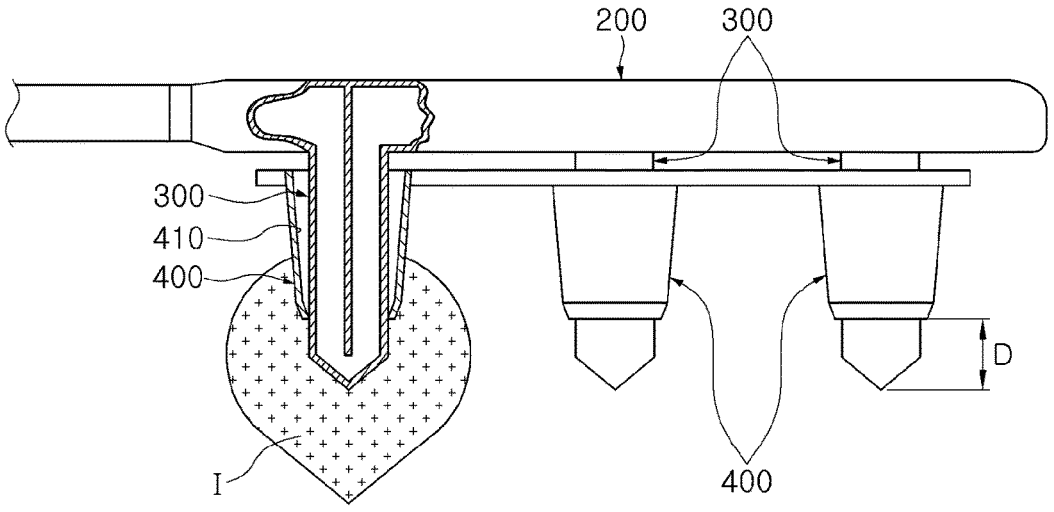

As illustrated in FIG. 3, the through-hole 410 of the heat transfer control member 400 may have a form corresponding to that of the ice making member 300. Accordingly, as illustrated in FIG. 3, cylindrical ice I may be produced in a form corresponding to that of the ice making member 300 on the heat transfer control member 400.

Figure 6:
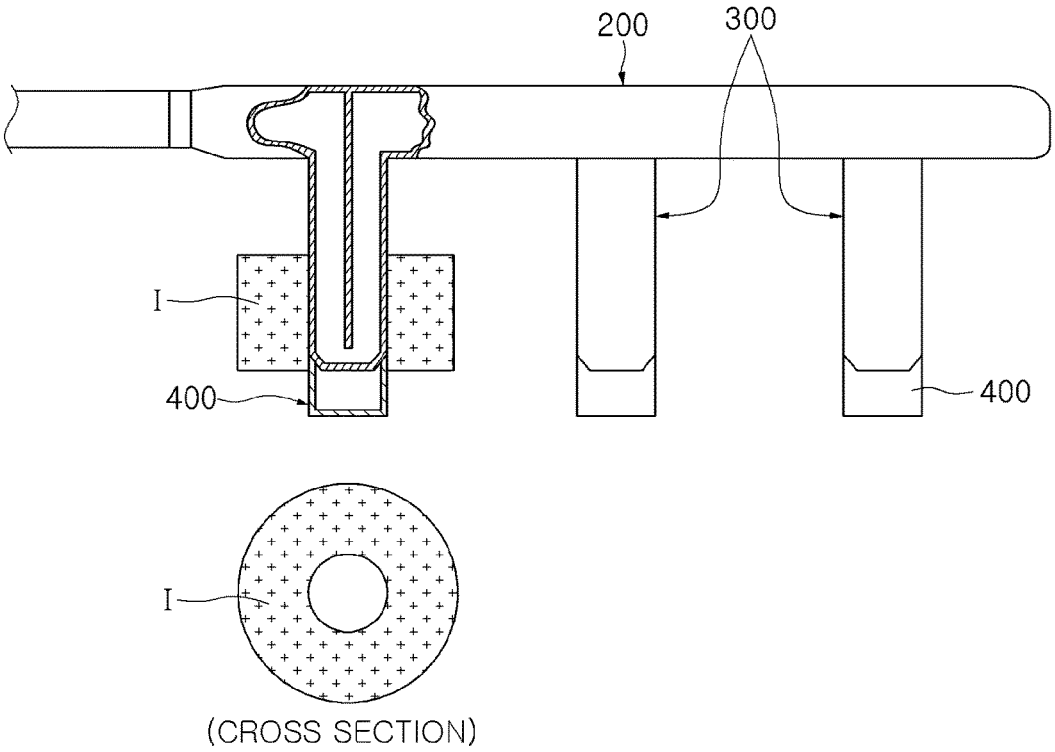

Also, as illustrated in FIG. 6, the heat transfer control member 400 may be disposed below the lower portion of the ice making member 300 through being attached thereto. In this instance, as illustrated in FIG. 6, ice I may not be formed on the heat transfer control member 400, and thereby ring-shaped ice I may be produced.

However, the form of the heat transfer control member 400 or the position of the heat transfer control member 400 with respect to the ice making member 300 is not limited thereto, and any form or position thereof allowing various forms of ice I to be produced may be used.

As illustrated in FIGS. 1 through 5, the heat transfer control members 400 provided in the ice making members 300, respectively, may be connected to one another. For example, the plurality of heat transfer control members 400 may be connected to one another through the injection molding of synthetic resins. In addition, based on such a configuration, the plurality of heat transfer control members 400 may be provided in the plurality of ice making members 300 simultaneously. However, the heat transfer control members 400 provided in the ice making members 300, respectively, may be separated from one another as illustrated in FIG. 6, or at least two of the heat transfer control members 400 may be connected to one another.

Figure 7:
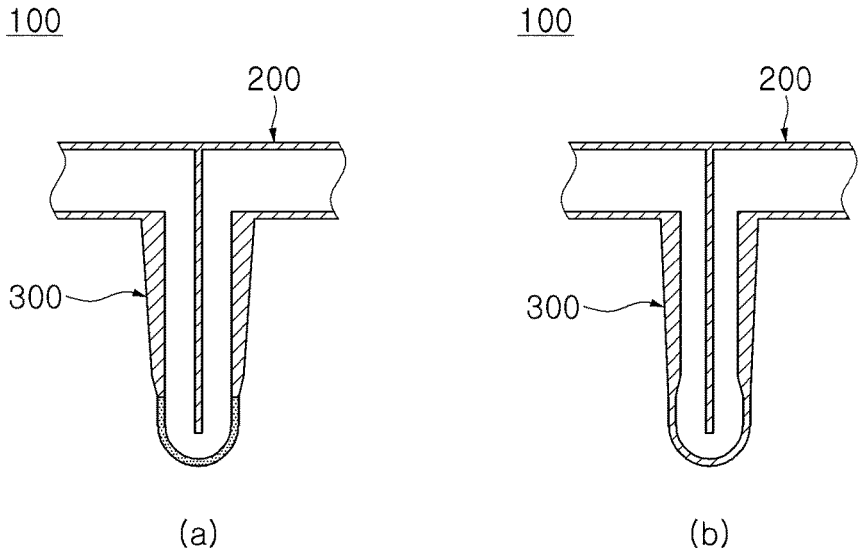
FIG. 7 is views illustrating examples of an ice making member of an ice maker according to exemplary embodiments of the present disclosure.

In order to vary the amount of heat transferred between the ice making member 300 and the water being in direct or indirect contact with the ice making member 300 according to the portions of the ice making member 300, the ice making member 300 may be formed of two or more materials having different heat transfer rates as illustrated in (a) of FIG. 7. Further, to this end, as illustrated in (b) of FIG. 7, the ice making member 300 may have different thicknesses varying according to the portions of the ice making member 300.

Figure 2:
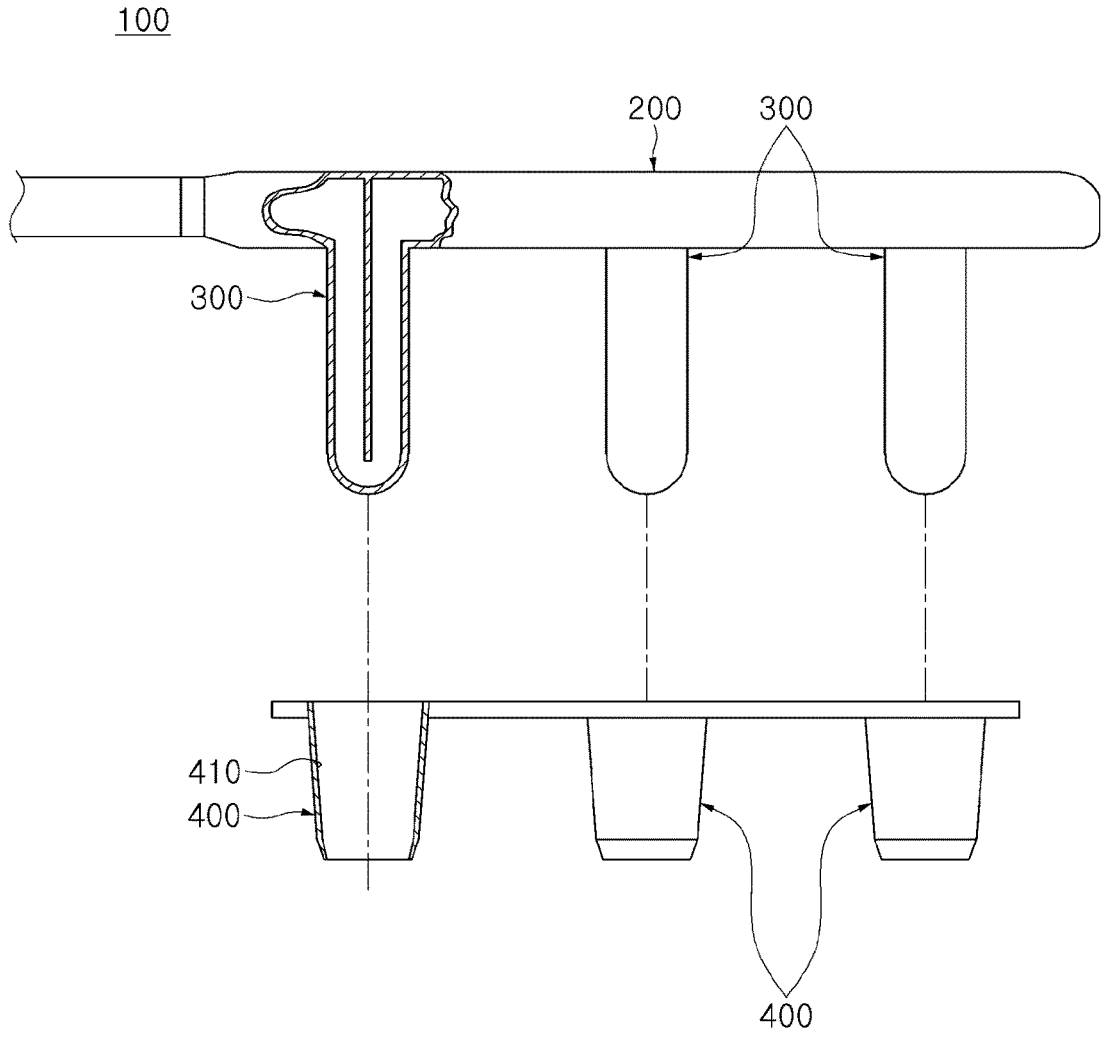
FIG. 2 is a view illustrating a heat transfer control member of an ice maker being separated therefrom according to an exemplary embodiment of the present disclosure.

The ice making member 300 of the ice maker 100 may have a rounded lower portion as illustrated in FIGS. 1 and 2 to produce rounded ice I without edges as illustrated in FIGS. 8 through 10. Also, an amount of heat transferred to the lower portion of the ice making member 300 may be greater than an amount of heat transferred to a portion of the ice making member 300 other than the lower portion of the ice making member 300. Additionally, the amount of heat transferred to the portion of the ice making member 300 other than the lower portion of the ice making member 300 may be decreased in an upward direction thereof.

Accordingly, as illustrated in FIGS. 8 through 10, ice I may be produced starting from the lower portion of the ice making member 300 having a relatively large amount of heat transferred thereto, and the ice I may grow relatively rapidly. On the other hand, on the portion of the ice making member 300 other than the lower portion of the ice making member 300 having an amount of heat transferred thereto smaller than that transferred to the lower portion of the ice making member 300, ice I may be produced relatively subsequently, and the ice I may grow relatively slowly. As a result, as illustrated in FIGS. 8 through 10, rounded ice I without edges, especially spherical ice I may be produced on the ice making member 300.

According to the exemplary embodiment, in order to produce such rounded ice I without edges, especially spherical ice I, an ice making mold in a form of a sphere or a hemisphere may not be required as in the conventional art. Therefore, rounded ice I without edges, especially spherical ice I may be produced through a simplified configuration, and thus in a convenient manner.

To this end, as illustrated in FIGS. 1 and 2, the heat transfer control member 400 having a heat transfer rate lower than that of the ice making member 300 may be provided in the ice making member 300. For example, the ice making member 300 may be formed of metal having a relatively high heat transfer rate, and the heat transfer control member 400 may be formed of synthetic resins having a relatively low heat transfer rate. However, the materials forming the ice making member 300 and the heat transfer control member 400 are not limited thereto, and any materials well known to one of ordinary skill in the art, ensuring that a heat transfer rate is lower in the heat transfer control member 400 than in the ice making member 300 may be used.

As illustrated in FIG. 1, the lower portion of the heat transfer control member 400 may be spaced apart from the lower portion of the ice making member 300 by a predetermined distance D. Accordingly, the amount of heat transferred to the lower portion of the ice making member 300 may be greater than that transferred to the portion of the ice making member 300 other than the lower portion of the ice making member 300.

In order to provide the heat transfer control member 400 in the ice making member 300, the through-hole 410 through which the ice making member 300 penetrates may be formed in the heat transfer control member 400 as illustrated in FIGS. 1 and 2.

As illustrated in FIGS. 1 and 2, the through-hole 410 may be narrowed in a laterally slanted manner to have a cross section decreasing in a downward direction thereof. As a result, as illustrated in FIGS. 1 and 2, a lower portion of the through-hole 410 may be tightly fitted to the ice making member 300. Also, a space S between the ice making member 300 and the through-hole 410 may be increased in an upward direction thereof. Accordingly, as a thickness of an air layer to be formed in the through-hole 410 is increased in an upward direction thereof, the amount of heat transferred to the portion of the ice making member 300 other than the lower portion of the ice making member 300 may be decreased in an upward direction thereof.

Further, in order to allow the amount of heat transferred to the lower portion of the ice making member 300 to be greater than that transferred to the portion of the ice making member 300 other than the lower portion of the ice making member 300 while also allowing the amount of heat transferred to the portion of the ice making member 300 other than the lower portion of the ice making member 300 to be decreased in an upward direction thereof, the heat transfer control member 400 may be provided in the ice making member 300. Although not illustrated, the through-hole 410 may have a form corresponding to that of the ice making member 300, and a thickness of the heat transfer control member 400 may be increased in an upward direction thereof.

Based on the above configuration, as illustrated in FIG. 8, in an instance in which cooling occurs in the cooling unit 200 and the ice making member 300 is cooled, when a cold refrigerant flows in the cooling unit 200 and the ice making member 300 connected to the cooling unit 200, ice I may be produced starting from the lower portion of the ice making member 300 having a relatively great amount of heat transferred thereto. In this instance, since the lower portion of the ice making member 300 is rounded, rounded ice may be produced on the lower portion of the ice making member 300 as illustrated in FIG. 8. As also illustrated in FIG. 8, since water in the vicinity of the portion of the ice making member 300 other than the lower portion of the ice making member 300 is not cooled to below zero degrees Celsius, freezing point, a temperature at which ice I may be produced, ice I may not be produced thereon.

Heat may be continuously transferred from water in the vicinity of the ice making member 300 to the ice making member 300 over time, water may be cooled to below zero degrees Celsius, freezing point, in the portion of the ice making member 300 other than the lower portion of the ice making member 300, and ice I may start to be produced as illustrated in FIG. 9. Since an amount of heat transferred to the portion of the ice making member 300 other than the lower portion of the ice making member 300 is decreased in an upward direction thereof, a size of ice I to be produced on the portion of the ice making member 300 other than the lower portion of the ice making member 300 may be decreased in an upward direction thereof. Simultaneously, ice I produced relatively in advance on the lower portion of the ice making member 300 may grow as described hereinbefore.

Accordingly, rounded ice I without edges, especially spherical ice I may be produced and grow on the ice making member 300. As illustrated in FIG. 10, the rounded ice I without edges, especially spherical ice I may grow to have a predetermined size. The rounded ice I without edges, especially spherical ice I may be separated from the ice making member 300 through a hot refrigerant flowing in the cooling unit 200, an evaporator, and in the ice making member 300, or by heating the ice making member 300 using a heating element (not illustrated) provided in the cooling unit 200 or the ice making member 300. The rounded ice I without edges, especially spherical ice I may be supplied and stored in an ice storage (not illustrated) and supplied to a user.

As illustrated in (a) of FIG. 7, the ice making member 300 may be formed of two or more materials having different heat transfer rates. For example, the lower portion of the ice making member 300 may be formed of a material having a relatively high heat transfer rate, and the portion of the ice making member 300 other than the lower portion of the ice making member 300 may be formed of a material having a relatively low heat transfer rate. In addition, the portion of the ice making member 300 other than the lower portion of the ice making member 300 formed of the material having the relatively low heat transfer rate may have a thickness increasing in an upward direction thereof as illustrated in (a) of FIG. 7.

Further, as illustrated in (b) of FIG. 7, the ice making member 300 may have different thicknesses varying according to the portions of the ice making member 300. For example, a thickness of the lower portion of the ice making member 300 may be relatively thin while a thickness of the portion of the ice making member 300 other than the lower portion of the ice making member 300 may be greater than that of the lower portion of the ice making member 300. As illustrated in (b) of FIG. 7, a portion having a relatively great thickness in the ice making member 300 may have a thickness increasing in an upward direction thereof.

Due to the above configuration, the amount of heat transferred to the lower portion of the ice making member 300 may be greater than that transferred to the portion of the ice making member 300 other than the lower portion of the ice making member 300, and the amount of heat transferred to the portion of the ice making member 300 other than the lower portion of the ice making member 300 may be decreased in an upward direction thereof, such that rounded ice I without edges, especially spherical ice I may be produced on the ice making member 300 to have a predetermined size.

Figure 11:
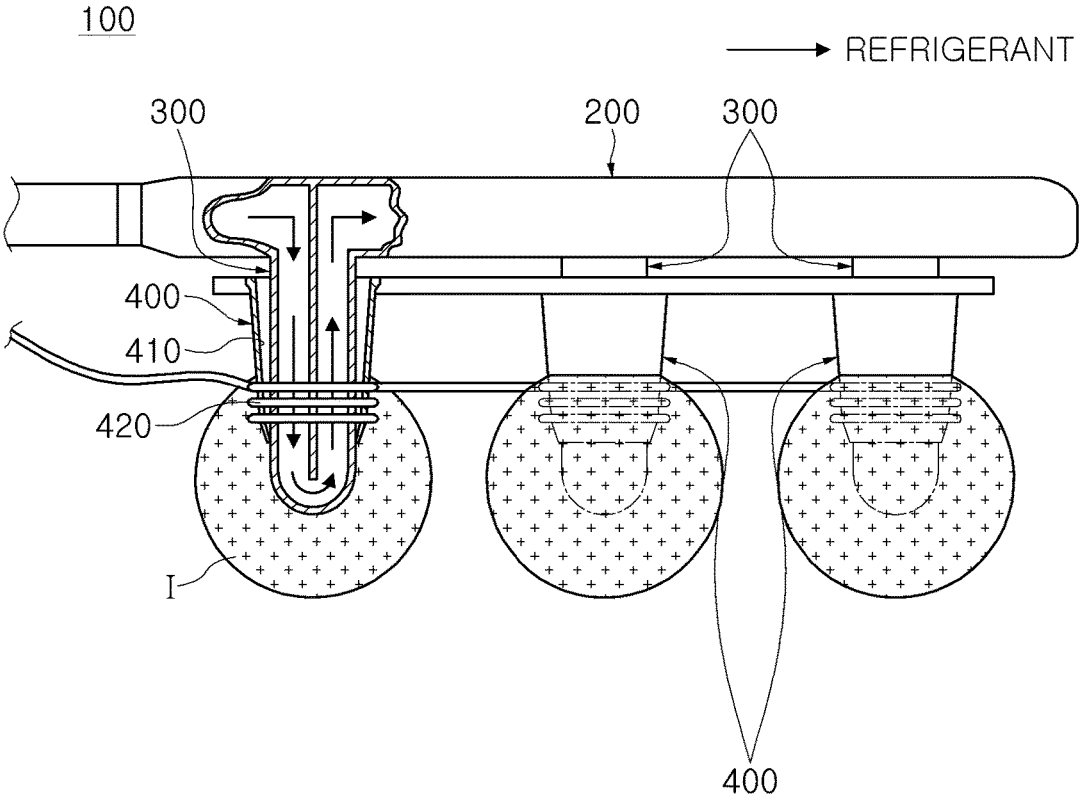
FIG. 11 is a view illustrating an ice maker in which a heat transfer control member is provided with a heating element to enable separation of ice according to another exemplary embodiment of the present disclosure.

As illustrated in FIG. 11, the heat transfer control member 400 may be provided with a heating element 420. Using the heating element 420, ice I produced on the ice making member 300 may be easily separated.

For example, as illustrated in FIG. 11, in an instance in which rounded ice I without edges in a predetermined size is produced in the ice making member 300, when the heating element 420 operates while a hot refrigerant flows in the cooling unit 200, the ice making member 300 and the heat transfer control member 400 may be heated beyond zero degrees Celsius. Accordingly, a contact surface of ice I in contact with the ice making member 300 and the heat transfer control member 400 may be melted, resulting in ice I being separated therefrom and dropped by self-weight.

The dropped ice I may be transferred to an ice storage (not illustrated) and stored therein.

The heating element 420 may be disposed in a portion of the heat transfer control member 400 on which ice I is produced, for example, the lower portion of the heat transfer control member 400 as illustrated in FIG. 11.

Figure 12:
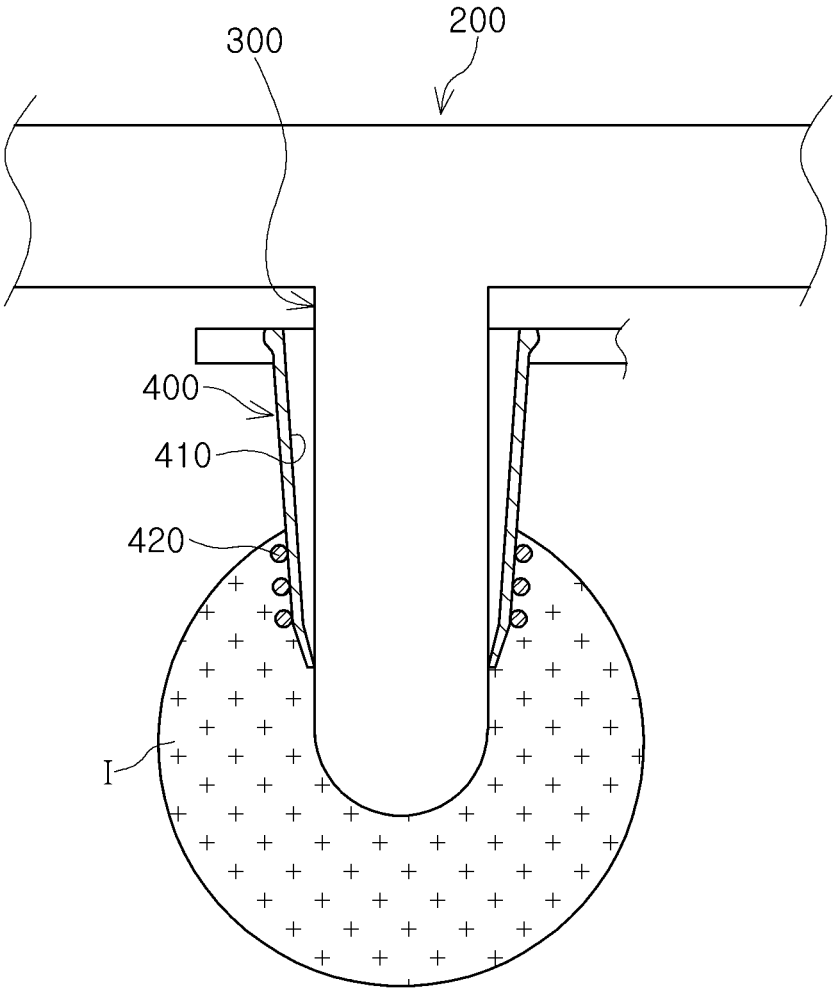
FIGS. 12 through 14 are views illustrating an ice maker in which a heat transfer control member is provided with a heating element according to another exemplary embodiment of the present disclosure.

As illustrated in FIG. 11, the heating element 420 provided in the lower portion of the heat transfer control member 400 may be an electric heating wire. As illustrated in FIG. 12, the electric heating wire may be provided around an outer circumference of the heat transfer control member 400. For example, the electric heating wire may be wound in a spiral manner around the outer circumference.

Figure 13:
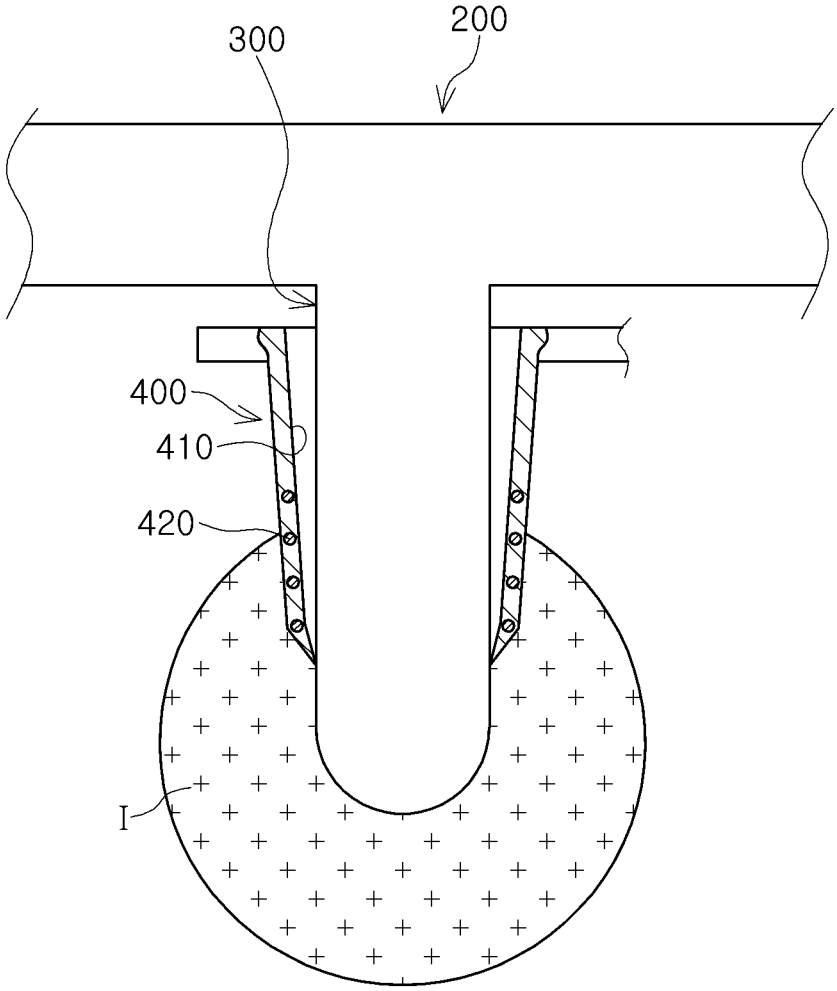

Also, as illustrated in FIG. 13, the electric heating wire may be inserted into the heat transfer member 400. The above configuration may be provided in an integrated manner in which the heating element 420 is inserted into the heat transfer control member 400.

Figure 14:
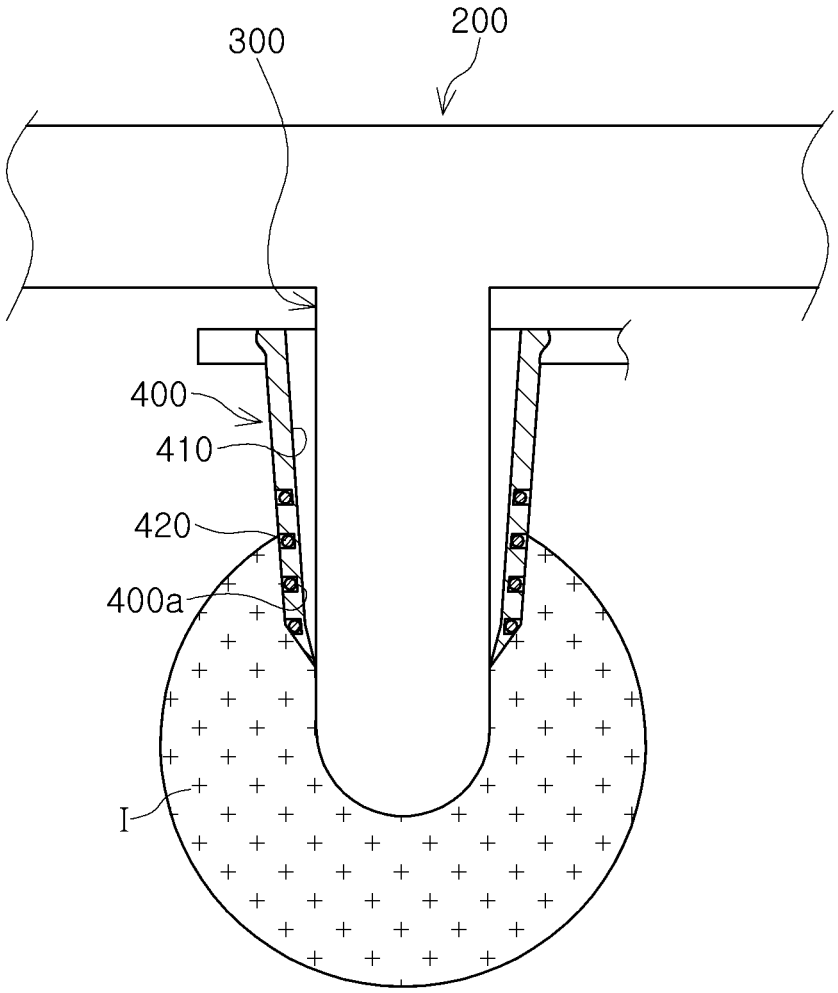

Further, as illustrated in FIG. 14, an electric heating wire groove 400*a* may be formed in the heat transfer control member 400. For example, the electric heating wire groove 400*a* may be formed in a spiral manner in the heat transfer control member 400. The electric heating wire may be provided in the electric heating wire groove 400*a* of the heat transfer control member 400.

As illustrated in FIG. 11, the electric heating wires provided in the heat transfer control member 400 may be connected to one another. Also, the electric heating wires may be electrically connected to an electric power source (not illustrated).

The heating element 420 may be provided as any type thereof well known to one of ordinary skill in the art, aside from the aforementioned electric heating wire, such as a planar heating element, capable of facilitating separation of ice I while being provided in the heat transfer control member 400.

Figure 15:
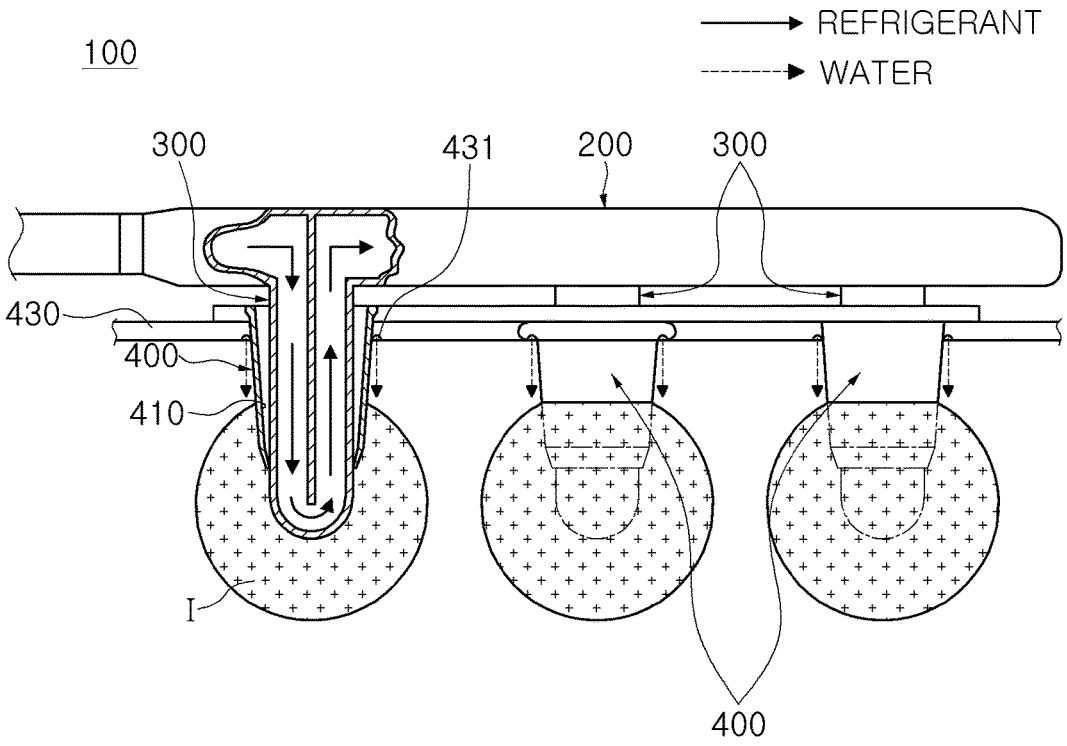
FIG. 15 is a view illustrating an ice maker in which water flows along an outer circumference of a heat transfer control member during separation of ice according to another exemplary embodiment of the present disclosure.

As illustrated in FIG. 15, during separation of ice I, water may flow along the outer circumference of the heat transfer control member 400. For example, water may flow along the outer circumference of the heat transfer control member 400 while a hot refrigerant flows in the cooling unit 200. Accordingly, a portion of ice I in contact with the heat transfer control member 400 may be melted relatively easily, such that ice I may be easily separated from the heat transfer control member 400.

To this end, as illustrated in FIG. 15, a water supply pipe 430 may pass through an upper portion of the heat transfer control member 400. The water supply pipe 430 may be connected to a water source (not illustrated). Accordingly, water may flow through the water supply pipe 430. Further, a supply hole 431 may be formed in the water supply pipe 430 to allow water to flow along the outer circumference of the heat transfer control member 400. The supply hole 431 may include a plurality of supply holes.

However, the manner of water flowing along the outer circumference of the heat transfer control member 400 is not limited to what is described hereinbefore and what is illustrated in FIG. 15, and any flowing manner well known to one of ordinary skill in the art may be used.

As set forth above, through use of the ice maker according to the exemplary embodiments, ice may be produced in various forms on an ice making member, through a relatively simplified configuration, ice may be produced in various forms relatively easily, and rounded ice without edges, especially spherical ice may be produced through a relatively simplified configuration, without using an ice making mold in a rounded, spherical, or hemispherical form.

The exemplary embodiments of the present disclosure may not be limited in the application thereof to the ice maker described above; however, the entirety or part of the exemplary embodiments may be selectively combined to allow various changes to be made thereto.

The invention claimed is:

1. An ice maker comprising:

a cooling unit performing cooling;

a heat transfer control member; and at least one ice making member connected to the cooling unit, wherein the at least one ice making member contacts water to allow ice to be produced thereon, wherein the heat transfer control member is provided with a through-hole through which the at least one ice making member penetrates, wherein a lower portion of the through-hole is tightly fitted to the at least one ice making member, wherein an amount of heat transferred between the at least one ice making member and the water being in direct or indirect contact with different axial locations of the at least one ice making member varies, such that ice is produced in various corresponding forms on the at least one ice making member, wherein the heat transfer control member has a heat transfer rate different from that of the at least one ice making member, and wherein the heat transfer control member is spaced apart from the cooling unit.

2. The ice maker of claim 1, wherein a lower portion of the at least one ice making member is provided in a rounded form to produce rounded ice on the at least one ice making member, and wherein a lower portion of the heat transfer control member is spaced apart from a lower portion of the ice making member by a predetermined distance.

3. The ice maker of claim 2, wherein an amount of heat transferred to the lower portion of the at least one ice making member is greater than that transferred to a portion of the at least one ice making member other than the lower portion of the at least one ice making member.

4. The ice maker of claim 3, wherein the amount of heat transferred to the portion of the at least one ice making member other than the lower portion of the at least one ice making member is decreased in an upward direction thereof.

5. The ice maker of claim 1, wherein a lower portion of the heat transfer control member is spaced apart from the lower portion of the at least one ice making member by a predetermined distance.

6. The ice maker of claim 1, wherein the through-hole is narrowed in a laterally slanted manner to have a cross section decreasing in a downward direction thereof, and a space between the at least one ice making member and the through-hole is increased in an upward direction thereof.

7. The ice maker of claim 1, wherein the through-hole has a form corresponding to a form of the at least one ice making member, and a thickness of the heat transfer control member is increased in an upward direction thereof.

8. The ice maker of claim 1, wherein the at least one ice making member is immersed in water in direct or indirect contact therewith.

9. The ice maker of claim 1, wherein the water is supplied to a tray member disposed below the at least one ice making member, and wherein the at least one ice making member is sprayed with water in direct or indirect contact therewith.

10. The ice maker of claim 1, wherein water flows in the at least one ice making member in direct or indirect contact therewith.

11. The ice maker of claim 1, wherein the heat transfer control member is provided with a heating element.

12. The ice maker of claim 11, wherein the heating element is an electric heating wire.

13. The ice maker of claim 12, wherein the electric heating wire is provided around an outer circumference of the heat transfer control member or is inserted into the heat transfer control member.

14. The ice maker of claim 5, wherein the heat transfer control member is provided with a heating element.

15. The ice maker of claim 1, wherein water flows along an outer circumference of the heat transfer control member when ice is separated.

16. The ice maker of claim 5, wherein water flows along an outer circumference of the heat transfer control member when ice is separated.

* * * * *